US007905458B2

(12) United States Patent
Hohensee

(10) Patent No.: US 7,905,458 B2
(45) Date of Patent: Mar. 15, 2011

(54) LADDER ACCESSORY DEVICE

(75) Inventor: William Lorne Hohensee, Hoquiam, WA (US)

(73) Assignee: BILLT, Inc., Hoquiam, WA (US)

( * ) Notice: Subject to any disclaimer, the term of this patent is extended or adjusted under 35 U.S.C. 154(b) by 276 days.

(21) Appl. No.: 12/322,027

(22) Filed: Jan. 28, 2009

(65) Prior Publication Data

US 2009/0308996 A1 Dec. 17, 2009

Related U.S. Application Data

(60) Provisional application No. 61/132,202, filed on Jun. 17, 2008.

(51) Int. Cl.
*E06C 7/14* (2006.01)

(52) U.S. Cl. ..... 248/210; 248/238; 248/235; 248/324; 248/286.1; 182/129

(58) Field of Classification Search ..... 248/210, 248/687, 238, 309.1, 310, 235, 239, 240, 248/250, 278.1, 279.1, 285.1, 236, 324, 326, 248/218.4, 914, 286.1; 182/120, 129, 187
See application file for complete search history.

(56) References Cited

U.S. PATENT DOCUMENTS

| | | | | | |
|---|---|---|---|---|---|
| 2,749,072 | A * | 6/1956 | Long | 248/214 |
| 3,319,916 | A * | 5/1967 | Malicoat | 248/210 |
| 3,729,160 | A * | 4/1973 | D'Imperio | 248/217.4 |
| 3,980,264 | A * | 9/1976 | Tomasik | 248/210 |
| 4,489,911 | A * | 12/1984 | Riley | 248/238 |
| 4,515,242 | A | 5/1985 | LaChance | |
| 4,662,594 | A * | 5/1987 | Dubis | 248/238 |
| 4,702,446 | A * | 10/1987 | Brown | 248/210 |
| 4,913,394 | A * | 4/1990 | Schmid | 248/238 |
| 5,135,193 | A | 8/1992 | Parris | |
| 5,181,682 | A | 1/1993 | Indelicato | |
| 5,293,957 | A * | 3/1994 | Lunden, Jr. | 182/129 |
| 5,934,632 | A | 8/1999 | Weaver | |
| 6,076,636 | A * | 6/2000 | Tietge | 182/129 |
| 6,254,045 | B1 * | 7/2001 | Oatsvall | 248/210 |
| 6,260,663 | B1 * | 7/2001 | Combs | 182/129 |
| 6,352,135 | B1 * | 3/2002 | Jones | 182/129 |
| 6,766,990 | B1 | 7/2004 | Hileman et al. | |
| 2007/0138225 | A1 * | 6/2007 | Duchesne | 224/544 |
| 2008/0017771 | A1 * | 1/2008 | Anderson | 248/238 |

* cited by examiner

*Primary Examiner* — Anita M King
(74) *Attorney, Agent, or Firm* — Steven P. Koda

(57) ABSTRACT

A ladder accessory device includes an arm and a sleeve for engaging a hollow rung of a ladder. While installed, the sleeve is generally stationary within the hollow rung. The arm is generally is free to rotate within the sleeve about a first axis defined by length of the arm. A member engages the arm at a first joint about which the arm may rotate. A platform engages the member at a second joint about which the platform may rotate. Motion about the first axis and motion about the first joint enable the platform to be generally self-leveling in two directions while the member suspends the platform at a level lower than the arm. Range of motion of the first joint and second joint extend sufficiently to allow the arm, member and platform to be stored in a generally parallel alignment.

12 Claims, 7 Drawing Sheets

LADDER ACCESSORY DEVICE

CROSS REFERENCE TO RELATED APPLICATIONS

This application claims the benefit of U.S. Provisional Patent Application No. 61/132,202, filed Jun. 17, 2008 entitled "Ladder Hand."

FIELD OF THE INVENTION

The present invention generally relates to ladder accessory devices, and more particularly to a device for attaching to a ladder to hold materials, tools, equipment, supplies or other items.

BACKGROUND OF THE INVENTION

Portable ladders, such as fixed ladders, extension ladders and step ladders, may be used by handymen, technicians and other persons for performing tasks. In some cases a step ladder may include a shelf for supplies. Typically, fixed ladders and extension ladders do not include a shelf. Accordingly there is a need for ladder accessory products. In particular it is desirable to have an accessory product for holding materials and tools, such as paint cans and paint brushes.

An example conventional ladder accessory typically hangs or clips on a ladder rung and hangs towards the center of the ladder creating an awkward maneuver to reach the paint can or tools. Some are simple platforms which hook to two rungs with no positive fasteners to keep the paint can on the platforms. Other ladder accessories insert into a hollow rung of a ladder and are self leveling but typically cannot be used with accessories such as paint and tool trays.

Accordingly, there is a need for an easy to use ladder accessory, such as may be used for safely supporting supplies, materials, tools and equipment. These and other needs are addressed by the inventions described herein.

SUMMARY OF THE INVENTION

The present invention provides a ladder accessory device for supporting, materials, supplies, equipment or tools. The device may be secured to a hollow-rung ladder with a sleeve of an arm engaging the hollow rung. The arm is generally free to rotate about a first axis defined by the length of the sleeve. A member engages the arm at a first joint about which the arm/sleeve may move. A platform engages the member at a second joint about which the platform may move. Motion about the first axis and motion about the first joint are generally free to enable the platform to be generally self-leveling in two directions while the member suspends the platform at a level lower than the arm. In some embodiments range of motion of the first joint and second joint extend sufficiently to allow the arm, member and platform to be stored in a generally parallel alignment.

The invention will be better understood by reference to the following detailed description taken in conjunction with the accompanying drawings.

BRIEF DESCRIPTION OF THE DRAWINGS

The invention is further described in the detailed description that follows, by reference to the noted drawings by way of non-limiting illustrative embodiments of the invention, in which like reference numerals represent similar parts throughout the drawings. As should be understood, however, the invention is not limited to the precise arrangements and instrumentalities shown. In the drawings.

DETAILED DESCRIPTION OF ILLUSTRATIVE EMBODIMENTS

In the following description, for purposes of explanation and not limitation, specific details are set forth in order to provide a thorough understanding of the present invention. However, it will be apparent to one skilled in the art that the present invention may be practiced in other embodiments that depart from these specific details.

Figure 1:
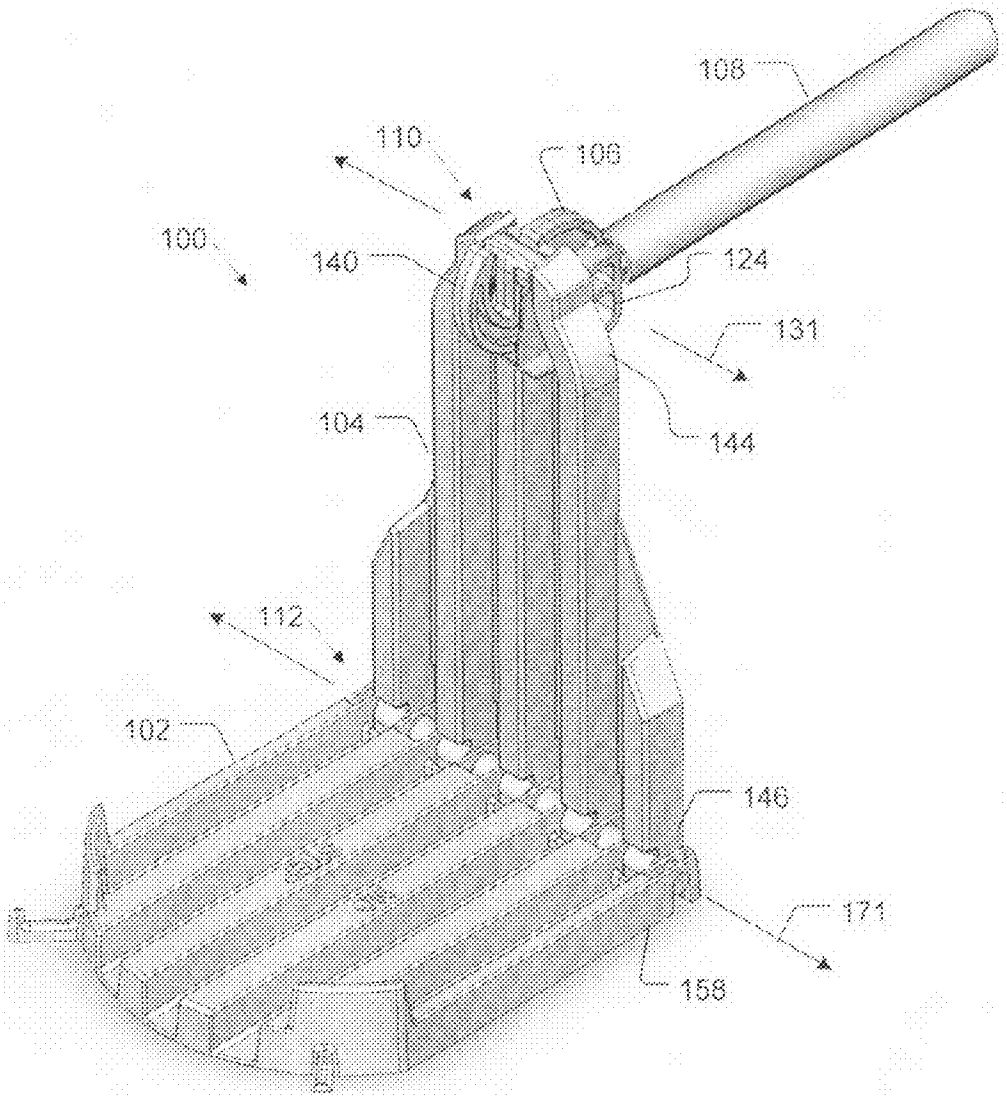
FIG. 1 is an illustration of a ladder accessory device, according to an example embodiment of the present invention.
Figure 2:
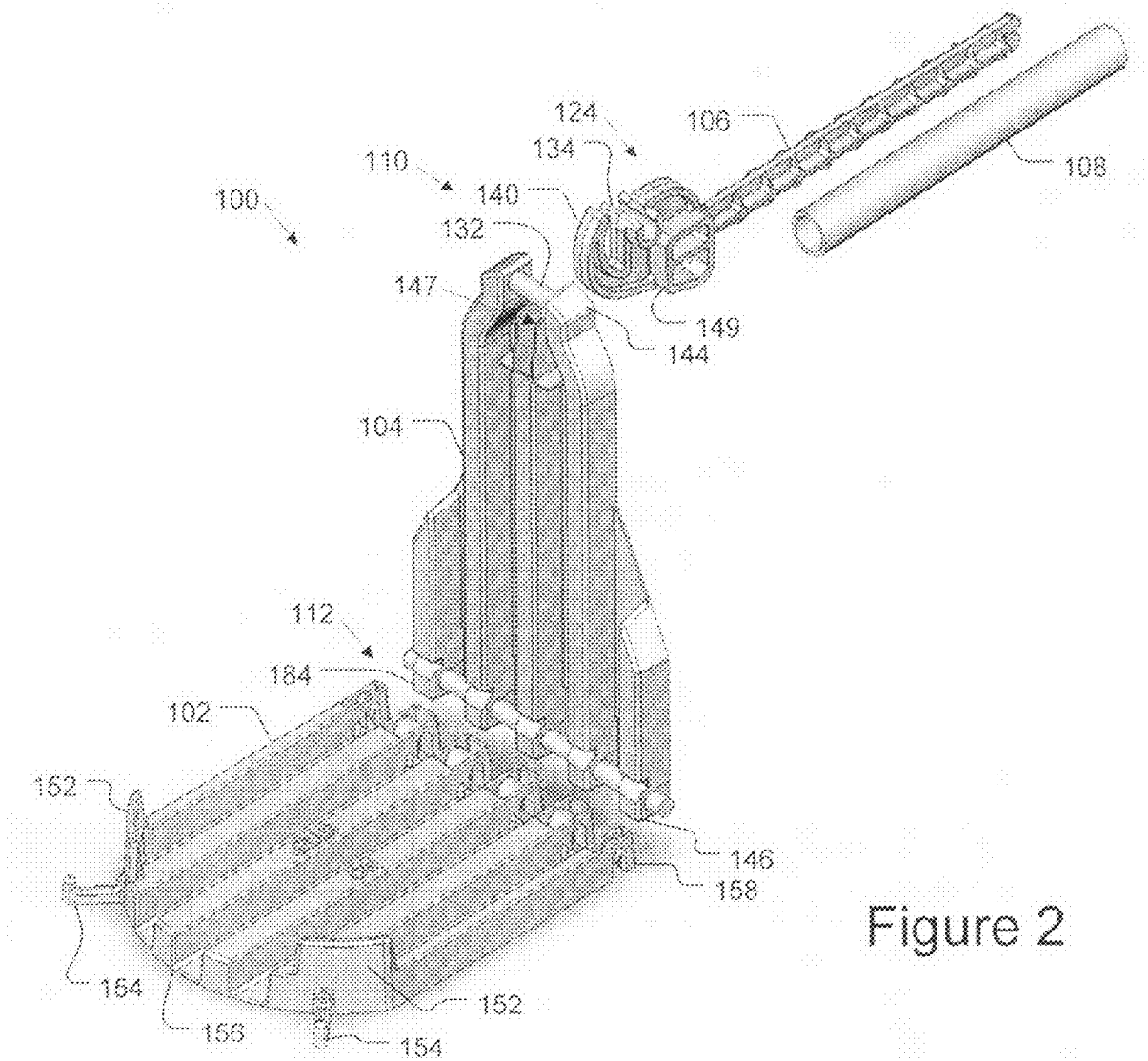
FIG. 2 is an exploded view of the ladder accessory device of FIG. 1.

According to an embodiment of the present invention, a ladder accessory device is self-leveling to support materials, supplies, equipment or tools. When the ladder is moved while the accessory device is installed, a platform portion of the accessory device remains generally level. In particular, movement is generally free about two axes, which enables the ladder accessory device to move and the platform to remain generally level. FIGS. 1-2 show an example embodiment of a ladder accessory device 100 including three members 102, 104, 106. One member is an arm 106 which may engage a hollow rung of a ladder. Another member is a platform 102 which may support the materials, supplies, equipment or tools. For example, the platform 102 may support a paint can or other container. The third member is a connecting member 104 between the arm 106 and the platform 102. The arm 106 may move relative to the connecting member 104 at one joint 110. The platform 102 may move relative to the connecting member 104 at a second joint 112.

In some embodiments the arm 106 is made of a hard, generally rigid, plastic material. A sleeve 108 may concentrically surround a substantial length of the arm. In an example embodiment the sleeve 108 may be formed by a hard plastic material at an inner surface adjacent to the arm and a soft rubber or other pliable material at an external surface outward from the arm 106. Relative movement between the sleeve 108 and arm 106 is free about an axis defined by the length of the arm (and coaxially located sleeve). In particular the sleeve is free to rotate while remaining on the arm with the hard plastic inner surface of the sleeve moving relative to the hard plastic outer surface of the arm. A cap may be attached (e.g., snapped into place) or otherwise positioned at the end of the arm and sleeve to keep the arm from sliding out from the sleeve. Thus, movement between the sleeve 108 and arm 106 is generally restricted along the length of the arm, so as to keep the arm from separating from the sleeve during normal use.

Figure 3:
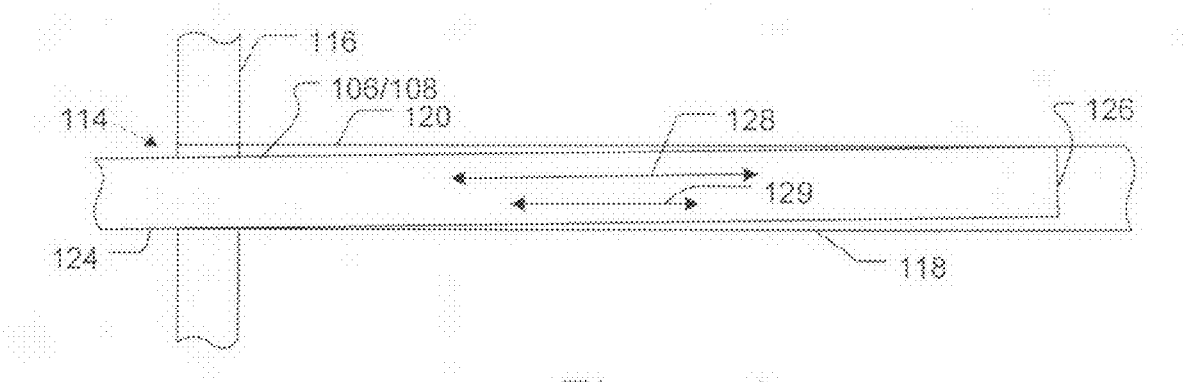
FIG. 3 is a diagram of an arm of the ladder accessory device installed within a hollow rung of a ladder.

As shown in FIG. 3, one manner of installing the accessory device 100 is to slide the arm and surrounding sleeve into an opening 114 of a ladder's 116 hollow rung 118. For some ladders, there is a lip at the opening to the hollow rung. The diameter of the sleeve 108 is generally less than the diameter or other cross sectional dimension of the rung's opening 114. By having a smaller diameter the ladder accessory device 100 is easy to install and easy to uninstall. The ladder accessory device 100 generally stays inserted within the rung due to the friction between the pliable outer surface of the sleeve 108 and aluminum, metal, fiberglass, or other material forming the walls 120 (and lip) of the ladder's hollow rung 118. In particular, the weight of materials being supported by the platform 102 forces a proximal end 124 of the arm closest to the rung opening 114 in a downward direction, while forcing the distal end 126 of the arm in an upward direction. The friction between sleeve 108 and the rung's inner walls 120 is defined by the coefficients of friction of the outer surface of the sleeve 108 and the inner surface 120 of the ladder's rung at the points of contact, along with the weight of the accessory device 100 and any materials being supported by the accessory device 100. Further, the soft outer surface of the sleeve indents at the lip (under the weight of the device 100 and supported materials) to provide additional friction along the various surfaces of the lip contacted by the sleeve.

Although the arm 106 remains inserted, the arm 106 may rotate within the hollow rung 118. More specifically, the arm 106 is free to rotate within the sleeve 108, while the sleeve 108 is generally fixed and stationary within the hollow rung 118. Accordingly, as the ladder 116 is moved the weight of the accessory device 100 may rotate the arm 106 (and the rest of the accessory device 100) within the sleeve 108. When materials are being supported by the installed accessory device 100, the weight of the accessory device 100 in combination with the weight of the materials being supported may rotate the arm 106. Accordingly, the arm 106 is generally free to rotate about an axis 128 defined by the coaxial lengths of the arm and sleeve to provide a self leveling capability to the accessory device 100 about the axis 128 of rotation. Such axis 128 of rotation is generally parallel with an axis 129 defined by the length of the ladder rung, but may differ slightly due to the arm/sleeve combination having a smaller diameter than the hollow rung 118.

Figure 4:
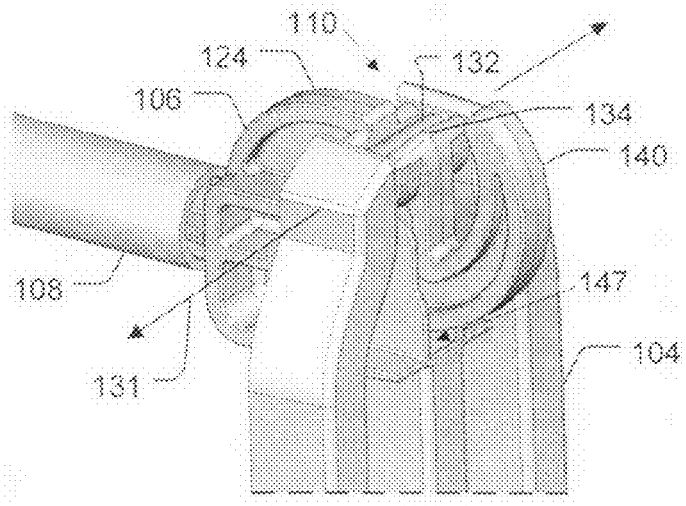
FIG. 4 is an illustration of a joint between an arm and a connecting member of the ladder accessory device, according to an example embodiment of the present invention.

FIG. 4 shows the arm 106 and connecting member 104 coupled together forming the joint 110. The joint 110 allows relative motion between the arm 106 and connecting member 104 with one degree of freedom (e.g., rotation about an axis 131). The joint 110 range of motion may extend from approximately 0 degrees to at least 270 degrees. In some embodiments the range of motion may extend to approximately 360 degrees.

In an example embodiment, the joint 110 is formed by an axle 132 at the connecting member 104 and a seat 134 at the arm 106, (see FIGS. 2 and 4). One of ordinary skill will appreciate that there are many other structures that may be embodied to achieve a joint allowing the arm 106 to move with at least one degree of freedom relative to the connecting member 104. In the illustrated embodiment, the seat 134 is generally contoured to mate with the shape of the axle 132. In particular the seat 134 has a generally circular surface which extends less than 360 degrees. An opening between extreme edges of the seat 134 has generally the same, yet a slightly shorter separation than the diameter of the axle 132. The difference is big enough to keep the seat 134 in place to ride the axle 132 while assembled, yet not so small as to allow the seat 134 to separate from the axle 132 and disassemble the joint 110 without applying a significant force perpendicular to the axle 132 along the line of separation. Accordingly, the arm 106 may snap to the connecting member 104 to mate the seat 134 to the axle 132. Similarly, the arm may be snapped away from the connecting member to un-mate the seat 134 and axle 132.

As shown in FIGS. 1, 2, and 4-6, the arm 106 may also include a hook 140. In an example embodiment the hook 140 is located at the proximal end 124 of the arm 106. When the accessory device 100 is assembled and installed, the hook 140 may be located to one side of the joint 110 axle 132 (see FIG. 1), while the arm 106 extends within the ladder rung to an opposite side. One of ordinary skill will appreciate that the relative position of the hook 140 may vary. It is desirable that the hook 140 be oriented relative to the connecting member 104 to receive a handle of a paint can or other container that may be supported by the platform 102.

Referring again to FIG. 2, the connecting member 104 may extend from a first end 144 positioned near the arm 106 to a second end 146 positioned near the platform 102. The axle 132 may be located near the first end 144. An opening 147 may be defined by the connecting member 104 near the axle 132 through which the proximal end 124 of the arm 106, including the hook 140, may move during relative motion between the arm 106 and connecting member 104 (see FIG. 4). In some embodiments the arm 106 may include a stop 149 (see FIG. 2), bumper or other surface to define a limit to the range of motion of the joint 110. For example, the stop 149 may prevent further rotation of the arm 106 at approximately 270 degrees or more by coming up against a surface of the connecting member 104. Such connecting member surface may be adjacent to the opening 147.

In an example embodiment the connecting member 104 is formed by molded plastic, a resin material or another light weight, generally rigid material. The shape and length of the connecting member 104 may vary. In the illustrated embodiment a ribbed structure is used to define a generally rigid structure. The length of the connecting member 104 may differ for various embodiments. In an example embodiment the connecting member 104 has a length between joints 110 and 112 greater than the height of a target material to be supported, (e.g., greater than the height of a typical one gallon can of paint; greater than the height of a five gallon container). Thus, the hook 140 may be at a level above the container, and the container handle may be supported by the hook 140 at a height greater than the container height.

As shown in FIGS. 1 and 2 the platform 102 extends from the connecting member 104 distally to define a surface for receiving materials, supplies, equipment or tools. In various embodiments the size and shape of the platform 102 may vary according to the materials to be supported. Further, an edge 152, rim or other structure extending to a height greater than the support surface may be defined to prevent a material resting on the support surface from sliding off the platform 102.

In an example embodiment the platform 102 is formed by molded plastic, a resin material or another light weight, generally rigid material. The shape and length of the platform 102 may vary. In the illustrated embodiment a ribbed structure is used to define a generally rigid structure. Each rib may extend to a common height, in which the distal edge of each rib defines a portion of the support surface. The length of the platform 102 may vary according to the embodiment and the desired material, equipment supplies or tools to be supported by the support surface.

In some embodiments, one or more hooks 154 may be attached or integrally formed at the platform 102 to support hanging objects. In particular a tool having an opening, a small container having a handle, or another object may be hung from a hook 154. In the illustrated embodiment, hooks 154 are located toward a distal end 156 of the platform 102 (see FIG. 2). In other embodiments the hooks 154 may be located anywhere along the periphery of the platform, so as to allow objects to be suspended.

Figure 5:
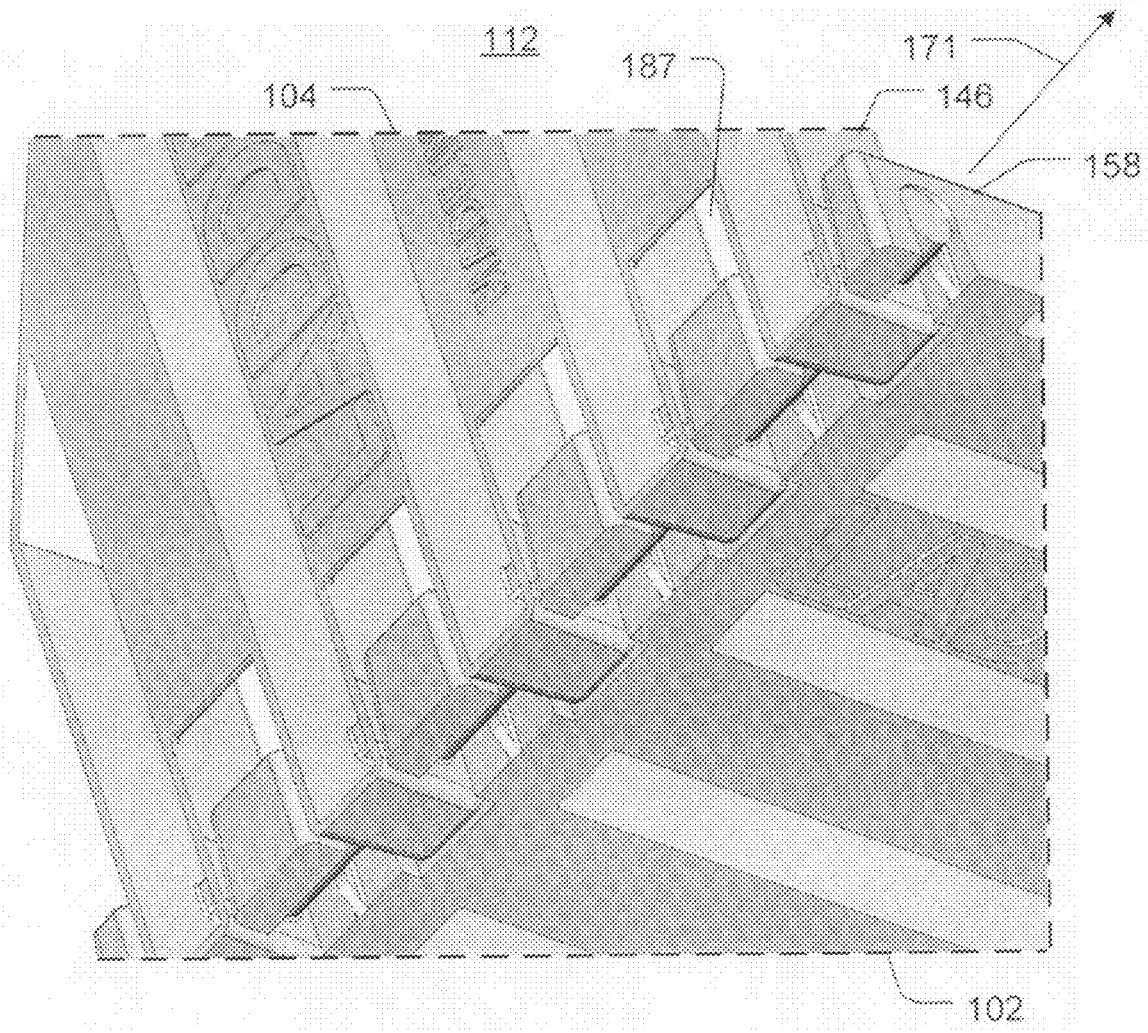
FIG. 5 is an illustration of a joint between a platform and the connecting member of the ladder accessory device, according to an example embodiment of the present invention.

FIGS. 1, 2 and 5 show the platform 102 and connecting member 104 coupled together forming the joint 112. The joint 112 allows relative motion between the platform 102 and connecting member 104 with one degree of freedom (e.g., rotation about an axis 171). The joint 112 range of motion may extend from approximately 0 degrees to approximately 90 degrees. In alternative embodiments the range of motion may differ. Although the relative position of the joint 112 components at the platform 102 and connecting member 104 may vary, in an example embodiment the joint 112 occurs between one end 146 of the connecting member 104 and a proximal end 158 of the platform 102.

Figure 6:
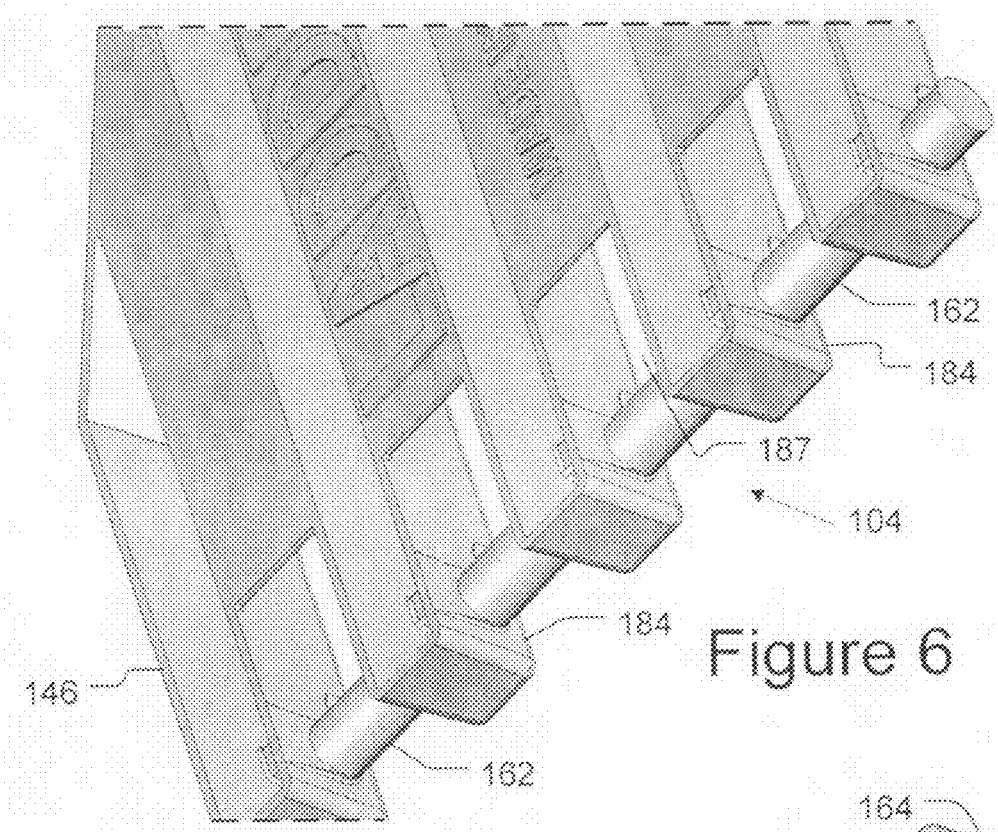
FIG. 6 is a partial illustration of the connecting member at an end forming a portion of the joint with the platform, according to an example embodiment of the present invention.
Figure 7:
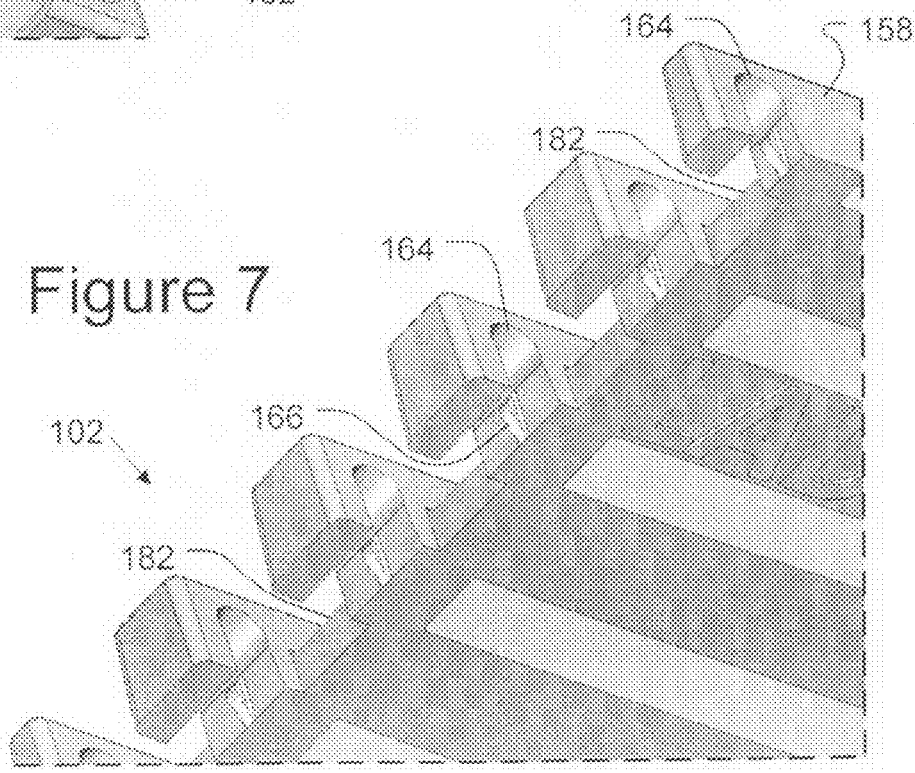
FIG. 7 is a partial illustration of the platform at an end forming a portion of the joint with the connecting member, according to an example embodiment of the present invention.

As shown in FIGS. 6 and 7, in an example embodiment, the joint 112 may be formed by one or more axles 162 at the connecting member 104 and one or more corresponding seats 164 at the platform 102. One of ordinary skill will appreciate that there are many other structures that may be embodied to achieve a joint allowing the platform 102 to move with at least one degree of freedom relative to the connecting member 104. In an example embodiment, each seat 164 may be generally contoured to mate with the shape of the corresponding axle 162. In particular each seat 164 may have a generally horseshoe shape, including a curved portion surface which receives its corresponding axle 162. A distance between legs of the horseshoe-shaped inner surface of each seat 164 may be generally the same as the diameter of the axles 162, or slightly larger, to allow rotation of the axles 162 along the curved portion of the seats 164. In some embodiments a ridge 166 may be formed along a leg of the inner surface of each seat 164. Such ridges 166 extend respectively to a height creating a distance from the distal point of the ridge to the opposite leg of the seat 164 which is slightly shorter than the diameter of each axle 162. The distance is short enough to keep the axle 162 in place to ride the seat 164 while assembled, yet not large enough to allow the axle 162 to separate from the seat 164 and disassemble the joint 112 under normal operating conditions. To assemble the joint 112, the connecting member 104 axles 162 are inserted into the horseshoe-shaped seats 164 and forced past the respective ridges 166 to rest in the curve of the respective seats 164. Accordingly, the platform 102 may snap to the connecting member 104 to mate each seat 164 to its corresponding axle 162. Similarly, the platform 102 may be snapped away from the connecting member to un-mate the seats 164 and axles 162.

Respective openings 187 (see FIGS. 5 and 6) may be defined by the connecting member 104 near the axles 162 through which the seats 164 of the platform 102 may move during relative motion between the platform 102 and connecting member 104. Referring again to FIGS. 6 and 7, one end of the range of motion for joint 112 is limited by the surfaces 182 located between each of the respective seats 164 and the surfaces 184 between each of the respective axles 162. At the end of the range of motion shown in FIG. 5 (e.g., at an approximately 90 degree angle between the platform 102 and connecting member 104) the surfaces 182, 184 butt up against each other.

Figure 8:
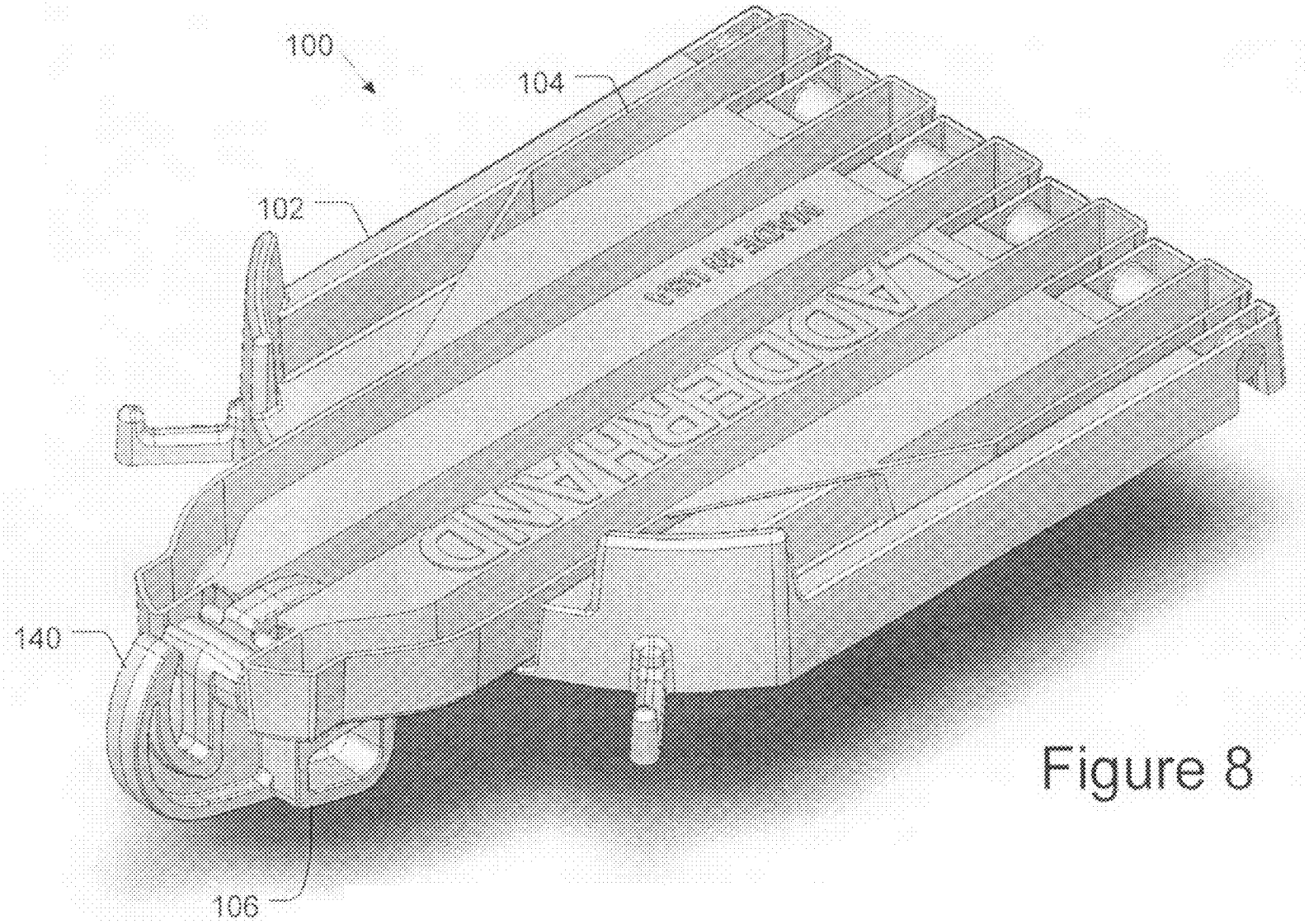
FIG. 8 is an illustration of the ladder accessory device of FIG. 1 in a closed position.
Figure 9:
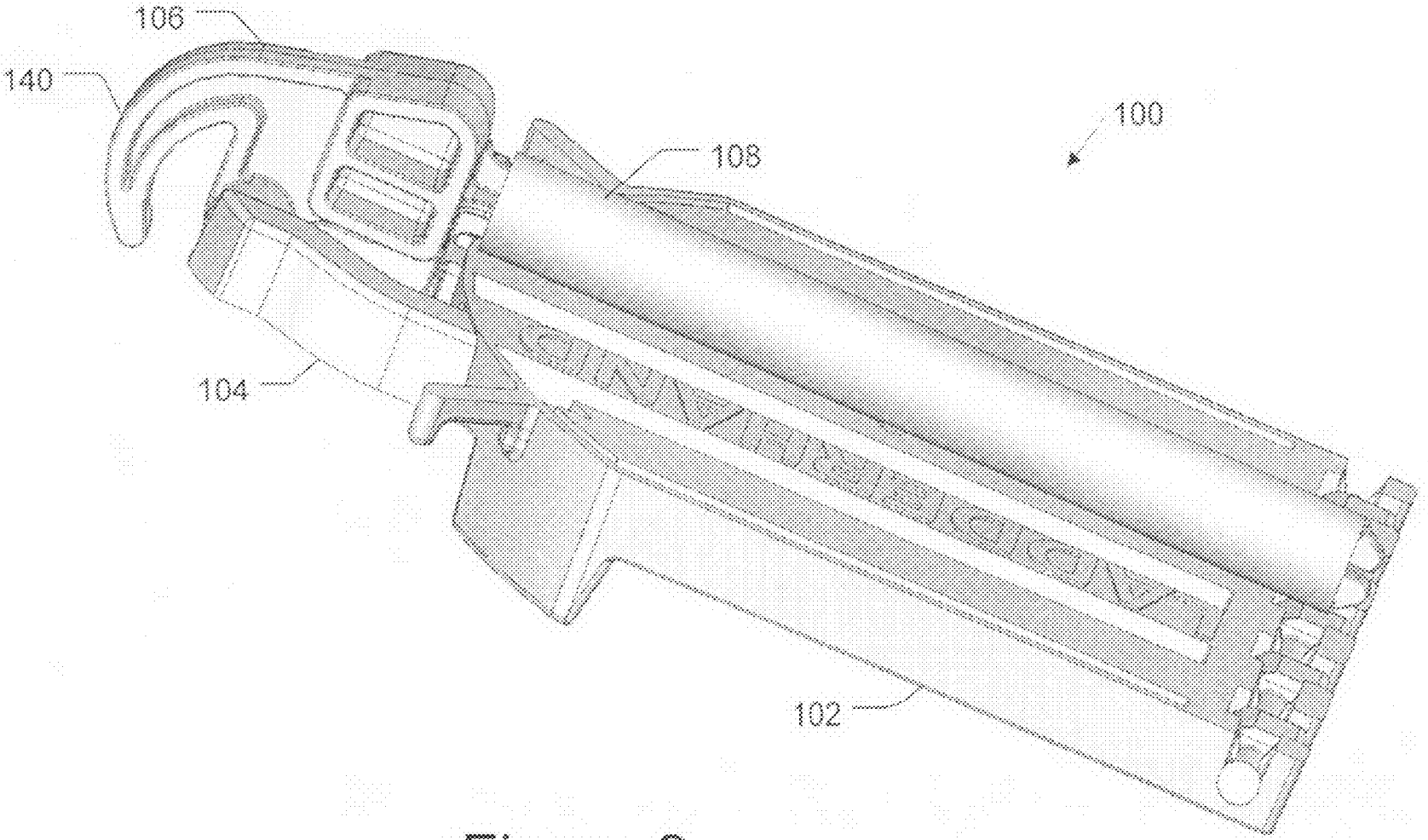
FIG. 9 is another illustration of the ladder accessory device of FIG. 1 in a closed position.

In an example embodiment both the connecting member 104 and platform 102 are generally ribbed structures. Such ribs are offset so as to allow the ribs of the platform 102 to mate with recessions between ribs of the connecting member 104. Similarly the ribs of the connecting member 104 may mate with recessions between ribs of the platform 102. FIGS. 8 and 9 show the ladder accessory device 100 in a storage position in which the ribs of the platform and connecting member are mated. At such mated position, the joint 112 is at one extreme of its range of motion—a beginning position where the platform 102 and connecting member 104 form an angle of approximately zero degrees. While in the storage position, the joint 110 also is at one extreme of its range of motion—a beginning position where the arm 106 and connecting member 104 form an angle of approximately zero degrees. Within such storage position, the arm 106, connecting member 104 and platform 102 are aligned to extend generally parallel to each other.

To alter the orientation of the accessory device 100, the arm 106 may be rotated about the axis 131 at joint 110. When the arm 106 is rotated to approximately 90 degrees relative to the connecting member 104, the platform 102 may be rotated about the axis 171 at joint 112. Note that the platform 102 may be free to start motion about axis 171 before the arm 106 completely clears the path of the platform 102. Furthermore, in embodiments where the axle 132 is offset from the distal end of the platform 102 while the accessory device 100 is in the storage position, the arm 106 clears the path of the platform 102 before the arm 106 is rotated to 90 degrees relative to the connecting member 104.

FIG. 1 shows the ladder accessory device 100 with the arm 106 oriented at approximately 270 degrees relative to the connecting member 104, and the platform 102 oriented at approximately 90 degrees relative to the connecting member 104. In an example embodiment these positions are the end positions for the range of motion of the joints 110, 112. To install the ladder accessory device 100, the arm 106/sleeve 108 is inserted into the hollow rung of a ladder. As the ladder is angled relative to a wall against which the ladder leans, the ladder accessory device 100 self levels as the arm 106 rotates within the sleeve 108, while the sleeve 108 remains generally stationary within the hollow rung. When a worker moves the ladder with the accessory device 100 installed, the angle of the ladder relative to the wall surface may change. In addition the ladder may be tipped slightly so that one leg of the ladder is higher from the ground relative to the other leg. The ladder accessory device 100 is self leveling relative to the angle between the ladder and the wall based upon rotation of the arm within the sleeve. The ladder accessory device 100 is self leveling relative to the tilt of the ladder relative to the earth surface (i.e., one ladder leg at different height than other ladder leg) by relative movement between the arm 106 and connecting member 104 at joint 110 axis 131. For example as the ladder is tilted for the leg having the accessory device to be lower than the other leg, the angle between the arm 106 and support member may adjust to be less than 270 degrees. As ladder is tilted for the leg having the accessory device to be higher than the other leg, the angle between the arm 106 and support member may adjust to be greater than 270 degrees (where the range of motion for such embodiment exceeds 270 degrees).

The ladder accessory device 100 has several benefits and advantages. In particular, the device 100 is self-leveling along two axes. It can be attached to a ladder with one hand. It may be pre-assembled for shipping to stores, and thus requires no assembly by the user. The device 100 can be flipped open from the closed position shown in FIGS. 8 and 9 to the open position of FIG. 1 with one hand and be ready for use. The device 100 folds flat for easy storage. The device 100 may position a paint can or other container to the side of ladder for safer and more comfortable use. The device hooks 154 may hold paint brushes while moving the ladder. Non-slip material on the sleeve 108 reduces chances of device 100 sliding off the ladder. Further, the ladder even may be moved while a paint can stays attached to the installed device 100. In some embodiments the accessory device can safely hold containers weighing up to 20 pounds. In different embodiments lighter or heavier weights may define the safe limits.

It is to be understood that the foregoing illustrative embodiments have been provided merely for the purpose of explanation and are in no way to be construed as limiting of the invention. Words used herein are words of description and illustration, rather than words of limitation. In addition, the advantages and objectives described herein may not be realized by each and every embodiment practicing the present invention. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention.

What is claimed is:

1. A ladder accessory device for use with a ladder, comprising:

an arm;

a sleeve concentrically surrounding at least a portion of the arm, wherein the arm may move within the sleeve about a first axis generally defined by length of the arm;

a member coupled to the arm, wherein the arm may move about a second axis relative to the member; and a platform coupled to the member;

wherein motions about the first axis and second axis enable the platform to be generally self-leveling in two directions with the member suspending the platform at a level lower than the arm.

2. The ladder accessory device of claim 1, wherein while installed at the ladder, the arm generally is free to rotate within the sleeve, while the sleeve remains generally stationary engaging a hollow rung of the ladder.

3. The ladder accessory device of claim 2, wherein the sleeve comprises a pliable outer surface resisting rotation of the sleeve about an axis defined by the ladder rung, and a generally non-pliable inner surface allowing relative motion between the arm and sleeve.

4. The ladder accessory device of claim 1, wherein the platform may move about a third axis relative to the member.

5. The ladder accessory device of claim 1, wherein the arm and member are coupled at a first joint, wherein the platform and member are coupled at a second joint, and wherein range of motion of the first joint and second joint extend sufficiently to allow the arm to be rotated about the second axis and the platform to be rotated about a third axis for the arm, member and platform to be stored in a generally parallel alignment.

6. The ladder accessory device of claim 5, wherein the member is ribbed and the platform is ribbed, wherein surfaces of the member and platform mate while in the generally parallel alignment.

7. The ladder accessory device of claim 1, wherein the platform and member are coupled at a joint, and wherein the joint has a range of motion extending between approximately 0 degrees and approximately 90 degrees.

8. The ladder accessory device of claim 1, wherein the arm and member are coupled at a joint, and wherein the joint has a range of motion extending at least from approximately 0 degrees to at least 270 degrees.

9. The ladder accessory device of claim 1, further comprising a hook located at the platform for supporting an object having an opening for receiving the hook.

10. The ladder accessory device of claim 1, further comprising, the sleeve having a generally pliable outer surface.

11. The ladder accessory device of claim 1, further comprising a hook extending from a height above the platform for receiving a handle of a container supported by the platform.

12. The ladder accessory device of claim 11, wherein the hook is integral to the arm and may rotate with the arm along a range of motion of the arm.

* * * * *